United States Patent [19]

Mills

[11] Patent Number: 4,940,048

[45] Date of Patent: Jul. 10, 1990

[54] BOAT-TYPE ROCKER ARM WITH FLANGES

[75] Inventor: Jesse V. Mills, Toledo, Ohio

[73] Assignee: Henley Manufacturing Holding Company, Inc., Hampton, N.H.

[21] Appl. No.: 434,857

[22] Filed: Nov. 9, 1989

[51] Int. Cl.[5] ..... F01L 1/18

[52] U.S. Cl. ..... 123/90.39; 123/90.41

[58] Field of Search ..... 123/90.39, 90.41, 90.47

[56] References Cited

U.S. PATENT DOCUMENTS

| | | | |
|---|---|---|---|
| 2,905,160 | 9/1959 | Sampietro | 123/90.39 |
| 2,905,161 | 9/1959 | Latham | 123/90.39 |
| 3,142,357 | 7/1964 | Thompson | 123/90.41 |
| 3,614,943 | 10/1971 | Schley | 123/90.42 |
| 3,667,434 | 6/1972 | Sandusky | 123/90.35 |
| 4,653,441 | 3/1987 | Belsanti | 123/90.39 |
| 4,799,464 | 1/1989 | Patel et al. | 123/90.41 |
| 4,858,575 | 8/1989 | Fittro et al. | 123/90.41 |

FOREIGN PATENT DOCUMENTS

| | | | |
|---|---|---|---|
| 0118360 | 9/1984 | European Pat. Off. | 123/90.39 |

*Primary Examiner*—David A. Okonsky
*Assistant Examiner*—Weilun Lo
*Attorney, Agent, or Firm*—Allen D. Gutchess, Jr.

[57] ABSTRACT

A one-piece, cold-formed rocker arm is disclosed. The rocker arm is of the boat type and includes a one-piece metal body which is cold-formed from a metal blank and is of U-shaped cross-sectional configuration throughout most of its length. The body has a bottom wall with structurally-integral side walls extending upwardly therefrom in generally parallel relationship. An intermediate, concave portion of the bottom wall has an opening therethrough which receives a fulcrum of a pivot post. One end portion of the rocker arm body has a recess to receive an end of a push rod which imparts pivotal motion to the rocker arm about the fulcrum. The other end of the rocker arm body has a pad for engaging an end of a valve stem to impart motion to the valve stem when the rocker arm is pivoted about the fulcrum. Outwardly-extending stiffening flanges are formed at upper edge portions of intermediate portions of the side walls, which provides strength and stiffness to the side walls. The flanges substantially eliminate or at least substantially reduce buckling of the side walls during operation of the rocker arm and thereby eliminate or substantially reduce deflection between the two end portions of the rocker arm body.

22 Claims, 2 Drawing Sheets

BOAT-TYPE ROCKER ARM WITH FLANGES

This invention relates to a boat-type rocker arm with stiffening flanges.

Boat-type rocker arms are well known in the art, as shown, for example, in U.S. Pat. Nos. 3,614,943; 3,667,434; and 4,799,464.

Cold-formed, specifically stamped, rocker arms have several advantages over cast rocker arms. Stamped rocker arms are usually less expensive to manufacture, particularly when produced in larger quantities so that die costs can be spread out more. In particular, stamped rocker arms are lighter in weight, an important advantage because lighter engines and vehicles result in better fuel economy and engine efficiency or, alternatively, in higher performance for the engine. In general, however, cast rocker arms tends to be more stiff than stamped ones.

Boat-type rocker arms are centrally pivotally supported and are engaged by a push rod at one end and, in turn, engage a valve stem at the other end during operation. Deflection in the rocker arm between its end portions during operation is seemingly minuscule. However, even a minute deflection has an effect on engine operation. Consequently, stiffness in a rocker arm is of substantial importance and absolute minimal deflection, if any, is desired for ultimate engine operation and efficiency.

The rocker arm embodying the invention is of the boat-type and is made by cold-forming operations, including stamping, coining, staking, and back-packing. The rocker arm includes a one-piece metal body which is of U-shaped cross-sectional configuration throughout substantially most of its length. The body includes a bottom wall with two structurally-integral side walls extending upwardly therefrom in general parallel relationship. The rocker arm body includes a recess formed in a first end portion thereof to receive an upper end of a push rod. A second end portion of the rocker arm has additional means to receive an end of a valve stem. An intermediate portion of the bottom wall of the body is generally concave, facing upwardly. A middle part of the concave portion has an opening through which a supporting pedestal extends, the pedestal having a fulcrum which engages the concave portion of the bottom wall to provide pivotal support for the rocker arm.

Intermediate portions of the side walls of the rocker arm are substantially parallel but may flare outwardly slightly, away from one another. During operation of boat-type rocker arms, the side walls tend to buckle, with the bottom wall deflecting. This changes the relationship between the two end portions of the rocker arm and can have an adverse effect on the operation of the engine.

In accordance with the invention, it has been found that the intermediate portions of the side walls of the rocker arm can be formed with flanges extending outwardly at upper edge portions thereof to substantially enhance the stiffness of the side walls of the rocker arm and cause deflection to be minimal during operation.

It is, therefore, a principal object of the invention to provide a cold-formed, boat-type rocker arm which is stiffer and has less deflection during engine operation.

Another object of the invention is to provide a cold-formed, boat-type rocker arm with longitudinally-extending, continuous flanges extending outwardly from upper edge portions of side walls of the rocker arm.

A further object of the invention is to provide a rocker arm of the boat type having the advantages and features discussed above.

Many other objects and advantages of the invention will be apparent from the following detailed description of a preferred embodiment thereof, reference being made to the accompanying drawings, in which.

Figure 1:
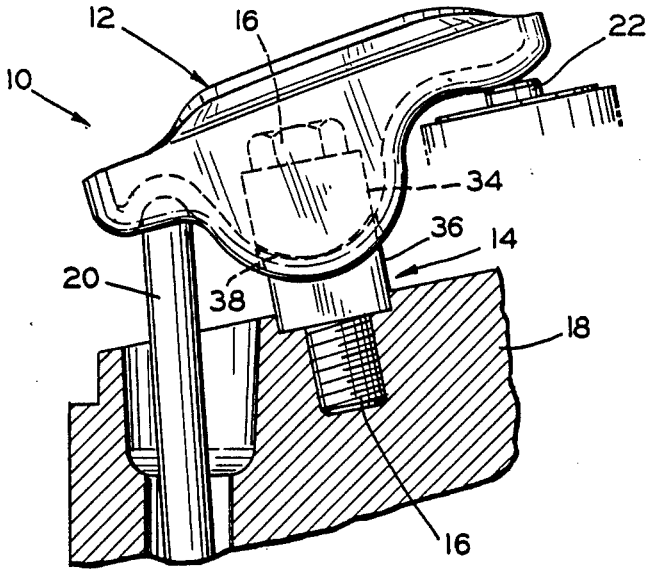
FIG. 1 is a somewhat schematic view in elevation of a rocker arm assembly in accordance with the invention, mounted on an engine block shown in section.
Figure 2:
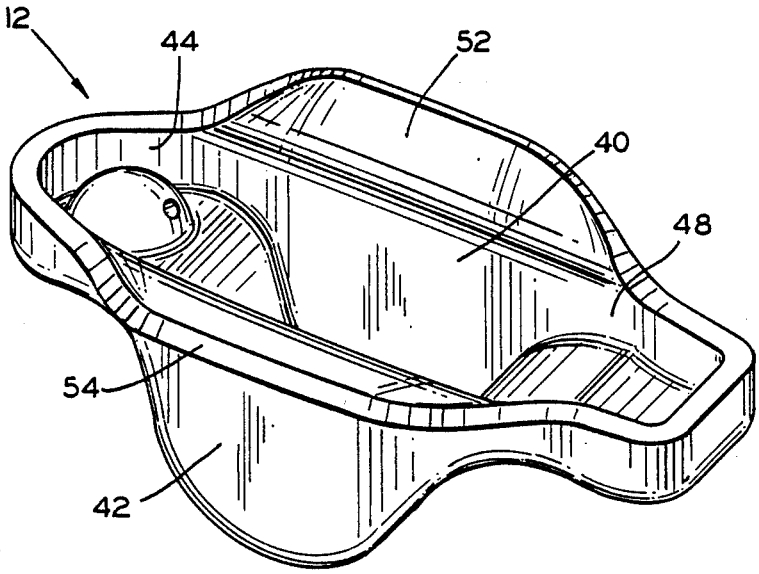
FIG. 2 is a view in perspective of the rocker arm shown in FIG. 1.

Referring particularly to FIG. 1, a rocker arm assembly in accordance with the invention is indicated at 10 and includes a boat-type rocker arm 12 mounted on a supporting pedestal 14. A suitable threaded fastener 16 extends through the pedestal and mounts the assembly on an engine block 18. One end of the rocker arm 12 engages the upper end of a push rod at 20 and the other end engages the upper end of a valve stem 22.

Figure 3:
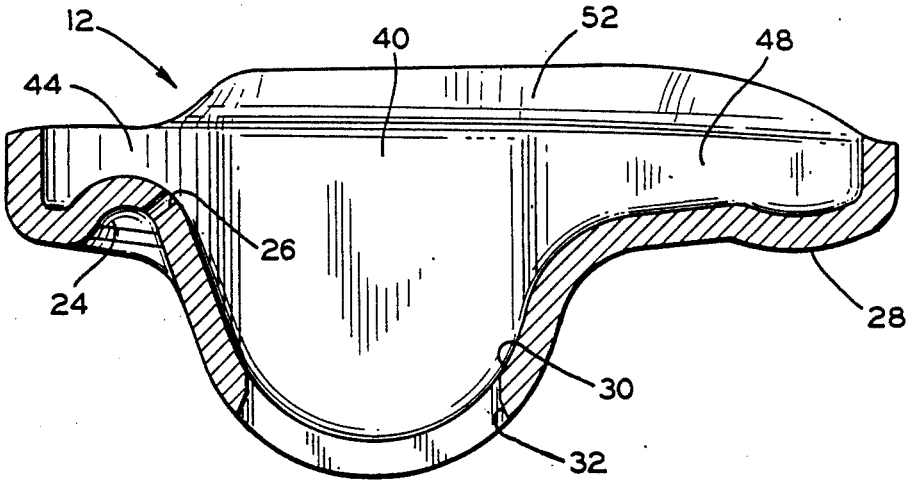
FIG. 3 is an enlarged view in longitudinal cross section taken through the rocker arm of FIG. 2.
Figure 4:
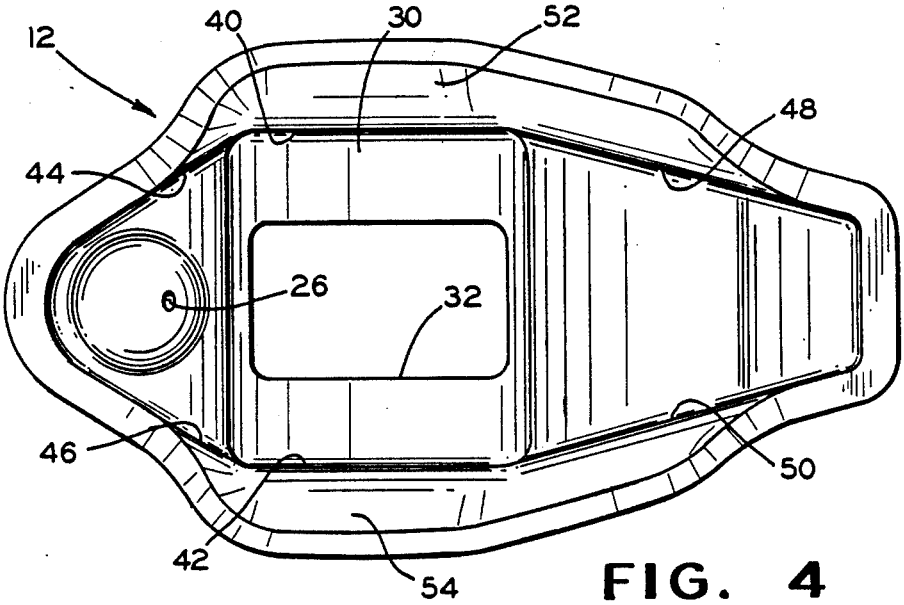
FIG. 4 is a top view of the rocker arm.
Figure 5:
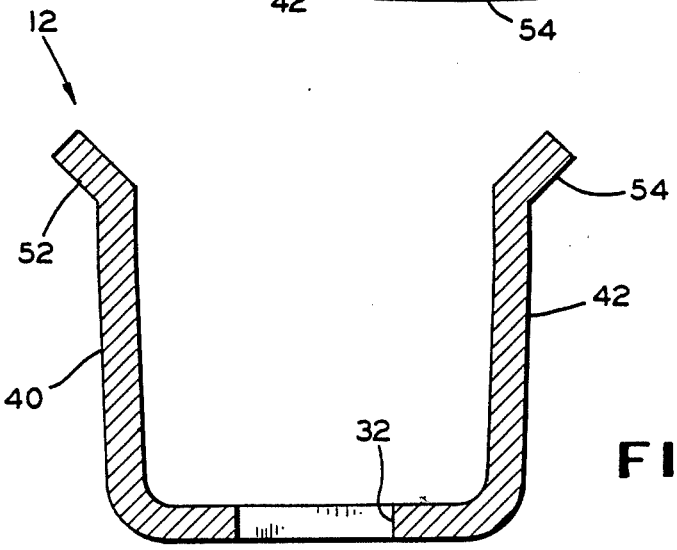
FIG. 5 is a view in transverse cross section taken through an intermediate portion of the rocker arm.

Referring particularly to FIG. 3, the rocker arm 12 has a concave recess 24 which receives the upper end of the push rod 20, with a lubricating hole 26 communicating with the recess 24 and with the interior of the rocker arm. The other end of the rocker arm 12 has a convex surface or rod 28 which engages the upper end of the valve stem 22. An intermediate portion of the rocker arm has a recessed area or surface 30 which is concave and of generally semi-cylindrical shape. As shown in FIGS. 3–5, the recess 30 has a centrally located rectangular opening 32 therein. The pedestal 14 includes a fulcrum or head 34 (FIG. 1) and a shank 36. The fulcrum 34 extends transversely beyond both sides of the shank 36 and has lower, downwardly-extending surfaces 38 which engage the concave surface 30 of the rocker arm 12.

The rocker arm 12 has substantially parallel side walls 40 and 42 which are structurally integral with the rocker arm bottom, specifically the recessed area 30 thereof, and extend upwardly in generally parallel relationship. The rocker arm also has angular side walls 44 and 46 extending angularly inwardly toward the left end of the rocker arm and angular side walls 48 and 50 extending angularly inwardly toward the right end of the rocker arm. Heretofore, the tendency of the rocker arm to buckle or deflect was greatest where the angular side walls 44–50 met the parallel side walls 40 and 42.

Upper edges of the side walls 40 and 42 and portions of the upper edges of the angular side walls 44–50 have outwardly-extending stiffening flanges 52 and 54 in accordance with the invention. The flanges 52 and 54 have widths which are from about ten percent to about forty percent of the height of the side walls 40 and 42 and preferably from about fifteen percent to about twenty-five percent of the height, tapering off at the angular walls 44–50. The flanges 52 and 54 extend continuously over the intermediate portions of the side walls 40 and 42 and portions of the angular walls 44–50 for a distance from about one-third to about three-fourths of the length of the rocker arm, and preferably from about forty percent to about sixty precent of the length. Stated another way, the flanges extend continuously over the length of the wide intermediate portion of the rocker arm 12 and taper off at the narrower end portions. As viewed in cross section in FIG. 5, the flanges 52 and 54 from an included angle of from about thirty degrees to about one hundred forty degrees and preferably from about seventy degrees to about one hundred ten degrees.

The flanges 52 and 54 of the side walls have been found to provide significant increased stiffness in the overall rocker arm and a resulting reduction in deflection of the rocker arm body and specifically between the two end portions thereof. The increased stiffness is believed to be due to a reduction in the tendency of the side walls to buckle during operation, which results in the bottom of the rocker arm deflecting. Consequently, the invention enables the rocker arm 12 to be cold-formed, and specifically stamped, with the advantages discussed above resulting from the cold-formed construction. At the same time, the rocker arm has the strength and stiffness of a cast one or at least substantially similar characteristics to a cast rocker arm.

Various modifications of the above described embodiment of the invention will be apparent to those skilled in the art, and it is to be understood that such modifications can be made without departing from the scope of the invention, if they are within the spirit and the tenor of the accompanying claims.

I claim:

1. A cold-formed, boat-type rocker arm comprising an elongate, one-piece metal body of generally U-shaped configuration in transverse cross section throughout most of its length, said body having a bottom wall and side walls extending upwardly therefrom and structurally integral therewith, said body having means at a first end portion thereof for receiving a push rod, said body having additional means at a second end portion thereof for receiving an end of a valve stem, said bottom wall having an intermediate opening therein at an intermediate portion of said body to receive pivot means about which said rocker arm can pivot, upper edge portions of said side walls having outwardly-extending, continuous flanges to provide stiffness for said side walls and to resist buckling of said side walls during operation of said rocker arm.

2. A rocker arm according to claim 1 wherein said flanges extend continuously for a distance from about one-third to about three-fourths of the overall length of said rocker arm body.

3. A rocker arm according to claim 1 wherein said flanges extend continuously for a distance from about forty percent to about sixty percent of the overall length of said rocker arm body.

4. A rocker arm according to claim 1 wherein said rocker arm body has a wide intermediate portion and narrower end portions with said flanges extending substantially the length of the intermediate portion.

5. A rocker arm according to claim 1 wherein said flanges form an included angle of from about thirty degrees to about one hundred forty degrees.

6. A rocker arm according to claim 1 wherein said flanges form an included angle of from about seventy degrees to about one hundred ten degrees.

7. A rocker arm according to claim 1 wherein said flanges have widths which are from about ten percent to about forty percent of the height of said side walls.

8. A rocker arm according to claim 1 wherein said flanges have widths which are from about fifteen percent to about twenty-five percent of the height of said side walls.

9. A rocker arm according to claim 1 wherein said flanges extend continuously for a distance of about one-third to about three-fourths of the overall length of said rocker arm body, said flanges form an included angle of from about thirty degrees to about one hundred forty degrees, and said flanges have widths which are from about ten percent to about forty percent of the height of said side walls.

10. A rocker arm according to claim 1 wherein said side walls of said body include generally parallel side walls and angular side walls extending inwardly toward both ends of said body, said flanges extending continuously over the length of the parallel side walls and tapering off at the angular side walls.

11. A cold-formed, boat-type rocker arm comprising an elongate, one-piece metal body of generally U-shaped configuration in transverse cross section throughout most of its length, said body having a bottom wall and side walls extending upwardly therefrom and structurally integral therewith, said body having a recess at a first end portion for receiving an end of a push rod, said body having a pad at a second end portion for engaging an end of a valve stem, said rocker arm having means at an intermediate portion thereof for receiving pivotal supporting means about which said rocker arm can be pivotally supported, upper edge portions of intermediate portions of said side walls having stiffening flanges extending upwardly and outwardly to provide stiffness for said side walls and to resist buckling of said side walls during operation of said rocker arm.

12. A rocker arm according to claim 11 wherein said flanges extend continuously for a distance from about one-third to about three-fourths of the overall length of said rocker arm body.

13. A rocker arm according to claim 11 wherein said flanges extend continuously for a distance from about forty percent to about sixty percent of the overall length of said rocker arm body.

14. A rocker arm according to claim 11 wherein said rocker arm body has a wide intermediate portion and narrower end portions with said flanges extending substantially the length of the intermediate portion.

15. A rocker arm according to claim 11 wherein said flanges form an included angle of from about thirty degrees to about one hundred forty degrees.

16. A rocker arm according to claim 11 wherein said flanges form an included angle of from about seventy degrees to about one hundred ten degrees.

17. A rocker arm according to claim 11 wherein said flanges have widths which are from about ten percent to about forty percent of the height of said side walls.

18. A rocker arm according to claim 11 wherein said flanges have widths which are from about fifteen percent to about twenty-five percent of the height of said side walls.

19. A rocker arm according to claim 11 wherein said flanges extend continuously for a distance of about one-third to about three-fourths of the overall length of said rocker arm body, said flanges form an included angle of from about thirty degrees to about one hundred forty degrees, and said flanges have widths which are from about ten percent to about forty percent of the height of said side walls.

20. A rocker arm according to claim 11 wherein said side walls of said body include generally parallel side walls and angular side walls extending inwardly toward both ends of said body, said flanges extending continuously over the length of the parallel side walls and tapering off at the angular side walls.

21. A rocker arm comprising an elongate, one-piece metal body having two generally parallel side walls and a connecting bottom wall therebetween, said body having angular side walls extending inwardly toward both ends of said body from said parallel side walls, upper edge portions of intermediate portions of said parallel side walls having stiffening flanges extending upwardly and outwardly to provide stiffness for said side walls, said stiffening flanges also extending over upper edge portions of said angular side walls, said rocker arm body having means for receiving a pivotal support, means for engaging a push rod, and additional means for engaging an end of a valve stem.

22. A rocker arm according to claim 21 wherein said stiffening flanges extend continuously for a distance from about forty percent to about sixty percent of the overall length of said rocker arm body, said flanges form an included angle from about seventy degrees to about one hundred ten degrees, and the width of said flanges is from about fifteen percent to about twenty-five percent of the height of said side walls.

* * * * *